US005114603A

United States Patent [19]

Kennedy et al.

[11] Patent Number: 5,114,603

[45] Date of Patent: May 19, 1992

[54] FRICTION REDUCING LUBRICATING OIL COMPOSITION

[75] Inventors: Steven Kennedy; David W. Eggerding, both of Naperville; Lionel D. Moore, Lisle, all of Ill.

[73] Assignee: Amoco Corporation, Chicago, Ill.

[21] Appl. No.: 328,873

[22] Filed: Mar. 27, 1989

Related U.S. Application Data

[63] Continuation of Ser. No. 153,331, Feb. 8, 1988, abandoned.

[51] Int. Cl.[5] ..... C10M 1/26

[52] U.S. Cl. ..... 252/56 R

[58] Field of Search ..... 252/56 R, 32.7 E, 51.5 A, 252/33.4

[56] References Cited

U.S. PATENT DOCUMENTS

| | | | |
|---|---|---|---|
| 1,692,784 | 11/1928 | Orelup et al. | 44/66 |
| 2,527,889 | 10/1950 | Moore et al. | 44/66 |
| 2,911,367 | 11/1959 | Baus et al. | 252/32.7 E |
| 3,235,498 | 2/1966 | Waldmann | 252/49.7 |
| 3,933,659 | 1/1976 | Lyle et al. | 252/32.7 E |
| 3,948,618 | 4/1976 | Niebylski | 44/70 |
| 4,066,789 | 1/1978 | Mores et al. | 252/56 R |
| 4,304,678 | 12/1981 | Schick et al. | 252/56 R |
| 4,459,223 | 1/1984 | Shaub et al. | 252/51.5 R |
| 4,683,069 | 7/1987 | Brewster et al. | 252/56 R |

*Primary Examiner*—Margaret Medley

*Attorney, Agent, or Firm*—Matthew R. Hooper; William H. Magidson; Robt. J. Wagner

[57] ABSTRACT

A lubricating oil composition which includes partial esters of glycerol substantially free from glycerol are disclosed. The partial esters of glycerol are present in an amount of about 0.05 to about one percent by weight, and include less than about 1 weight percent of unreacted glycerol based on the total weight of glycerol esters and free glycerol present. Enhanced reduction in friction and improved stability are obtained.

1 Claim, No Drawings

FRICTION REDUCING LUBRICATING OIL COMPOSITION

This is a continuation of application Ser. No. 153,331, filed Feb. 8, 1988 now abandon.

TECHNICAL FIELD

This invention relates to lubricating oil compositions containing glycerol monooleate to reduce friction in internal combustion engines.

BACKGROUND OF THE INVENTION

Lubricating oils are commonly used to reduce friction between moving parts, especially in internal combustion engines. As friction is reduced, fuel economy is improved.

It has been estimated that an average automobile loses 20 percent of the energy available for propulsion (7.5 percent of the total energy released in fuel combustion) due to engine friction. If these friction losses, occurring mainly around the piston ring and skirt area, could be eliminated, a fuel savings of up to about 6.5 miles per gallon could be realized. For this reason, the oil industry has spent considerable time and effort to develop superior lubricants capable of reducing engine friction without compromising the levels of performance and protection that the consumer has come to expect. This invention thus relates to a friction reducing lubricating oil composition which maintains the level of protection available in present commercially available lubricating oils while reducing friction.

It is known that glycerol monooleate is a friction reducer for crankcase lubricating oils. However, it is also known that when the glycerol monooleate is used as part of an automotive crankcase lubricating formulation in concentrations adequate to provide a significant decrease in friction, e.g., at concentrations greater than about 0.2 percent by weight, substantial difficulties are encountered in terms of composition instability and/or adverse performance in tests which measure other aspects of lubricating oil quality, e.g., the ASTM tests used to qualify an oil for satisfactory commercial use.

Lubricating oils are commonly modified to include various additives which increase the stability of the oil and increase the capacity of the oil to maintain contaminants properly dispersed. More particularly, conventional lubricating oils are well known to contain dispersants, viscosity index improvers, overbased sulfonates, phenates, zinc dithiophosphates, antioxidants, pour point depressants, and other components as needed to meet relevant viscosity targets and/or engine test performance requirements. These conventional lubricating oils exhibit reduced friction when they contain glycerol partial esters; however, the usual glycerol monooleates, when present, degrade the normally acceptable properties of the conventional oils and make them unacceptable.

SUMMARY OF THE INVENTION

This invention contemplates a lubricating oil composition having enhanced stability and friction-reducing capability. The present lubricating oil compositions contain partial esters of glycerol with oleic acid in an amount of about 0.05 to about one percent by weight, based on the total weight of the composition, but less than about 1 percent by weight of free or unreacted glycerol, based on the total weight of glycerol esters and glycerol present.

DESCRIPTION OF PREFERRED EMBODIMENTS

The present invention is based upon the discovery that the free glycerol normally present in glycerol monooleate is responsible for the adverse effects observed when glycerol monooleate is used at relatively high (i.e., greater than 0.2 percent) concentration. Even in oils containing less than about 0.2 percent of glycerol esters, these adverse effects are also expected to occur, though they may be somewhat less detrimental because the proportion of free glycerol introduced with the glycerol esters is reduced. Indeed, the adverse effects of glycerol monooleate on engine test performance can be eliminated by reducing the free glycerol content. This fact has not been recognized heretofore in the art.

Glycerol monooleate, as available in commerce, includes free glycerol (usually in an amount of at least about 5 percent), a small proportion of glycerol dioleate, about 7 percent unreacted oleic acid and some trioleate. It has now been determined that it is the unreacted glycerol which degrades conventional lubricating oils and prevents their effective utilization. Thus, the capacity of the glycerol monooleate to reduce friction cannot be utilized in a practical lubricating oil.

In contradistinction, the lubricating oil compositions of this invention contain partial esters of glycerol in an amount of downward from about 1 percent to about 0.05 percent, preferably about 0.7 percent to about 0.2 percent, based on the total weight of the composition. These partial esters include less than about 1 percent of free glycerol, based on the total weight of glycerol esters and glycerol present. That is, the free glycerol content of the present lubricating oil compositions is less than about 0.0095 percent by weight, based on the total weight of the composition.

The glycerol esters are preferably largely constituted by glycerol monooleate. Glycerol dioleate also is usually present, and in some instances it may be present in relatively large amounts. The dioleate also functions to reduce friction, thus the present lubricating oils may include combinations of the two in any proportion. As will be evident, when enough oleic acid is used to increase the proportion of dioleate, this fact alone will reduce the proportion of free glycerol present. Also, the free glycerol, being water soluble, can be removed by water washing when present in excessive amounts.

The present lubricating oils usually further include conventional additives, such as dispersants, viscosity index improvers, overbased sulfonates, phenates, zinc dithiophosphates, antioxidants, pour point depressants, and other components as needed to meet desired viscosity targets and/or engine test performance requirements.

The examples which follow illustrate the adverse effects of ordinary glycerol monooleate in the ASTM Sequence IIID engine test at concentrations above 0.2 percent, and the elimination of these adverse effects with the removal of glycerol. In this specification, including the examples, all parts and proportions are by weight, unless otherwise stated.

EXAMPLE 1

A 10W-30 SF/CC quality lubricating oil containing 7.5 percent of a proprietary nitrogen containing dispersant-viscosity index improver, 0.2 percent of a pour point depressant solution, 3.0 percent of a 40 percent solution of a high molecular weight Mannich dispersant, 13.1 percent of a zinc dithiophosphate (providing 0.08 percent phosphorus n the finished oil), 1 percent of a sulfur containing antioxidant, 0.65 percent of a calcium sulfonate, 0.9 percent of an overbased magnesium sulfonate, and 5 ppm of a silicone antifoam agent, all in a mixture of 100 N and 330 N base oils, was tested in the ASTM Sequence IIID oxidation stability test. This oil passed the IIID test with a viscosity increase of only about 219 percent after 64 hours (viscosity increases greater than 375 percent are considered failing). Wear, average sludge, piston varnish, ring land face varnish, and oil consumption were all deemed to have passing values.

To a lubricating oil formulation, substantially the same as that described above, was added 0.4 weight percent of commercially available glycerol monooleate which was found to contain 5 percent free glycerol. This oil failed the IIID test with a viscosity increase of about 2758 percent. This example demonstrates the detrimental effect of glycerol in the IIID oxidation stability test.

EXAMPLE 2

To the lubricating oil composition described in Example 1 was added 0.38 percent glycerol monooleate which had been extracted with water to remove the free glycerol contained therein. This lubricating oil was evaluated in the ASTM Sequence IIID test. The lubricating oil passed the test with a viscosity increase of only about 246 percent.

Similarly, 0.4 weight percent of a sample of glycerol monooleate containing 1 percent free glycerol passed the IIID test with a viscosity increase of 239 percent.

EXAMPLE 3

An ASIM Sequence VI dynamometer test was performed to demonstrate the fuel economy benefit that can be achieved using glycerol monooleate containing one percent by weight, or less, free glycerol. The test results are tabulated below.

| | % Fuel Economy Improvement Relative to High Reference Oil in ASTM Sequence VI Test[3] |
|---|---|
| No friction modifier[1] | 2.06% |
| 0.5% glycerol mono/dioleate[1,2] (glycerol free) | 3.61% |
| 0.5% glycerol mono/dioleate containing 1% glycerol | 3.58% |
| 0.5% glycerol mono/dioleate[1] containing 5% glycerol | 3.11% |
| 0.25 glycerol mono/dioleate[1] containing 5% glycerol | 2.05% |
| 0.25% glycerol mono/dioleate[1] containing 1% glycerol | 2.45% |

[1]All additives are part of a 5W-30 formulation containing a proprietary nitrogen containing dispersant-viscosity index improver (11.8 percent), a pour point depressant (0.2 percent), a high molecular weight Mannich dispersant (3 percent), a zinc dialkyl dithiophosphate (1.05 percent), a sulfur containing antioxidant (1.0 percent), a calcium sulfonate (1.50 percent), an overbased magnesium sulfonate (0.9 percent), an overbased calcium phenate (0.75 percent), a silicone antifoam and a mixture of 100N and 330N base oils.
[2]High glycerol content glycerol monooleate/glycerol dioleate was water extracted to produce a glycerol-free product.
[3]ASTM 5-car equivalent.

The lubricating oil compositions of the present invention encompass both straight and multigrade lubricating oils. It will normally be necessary to add additives in order to meet the specifications required for qualification as either a gasoline or diesel engine lubricating oil. These components may include viscosity index improvers and pour point depressants. In addition, other additives such as dispersants, phenates, rust inhibitors, antifoamants, antiwear additives, and the like may be blended into the lubricant compositions claimed herein without significantly detracting from the fuel conserving properties of the lubricant. The dispersants useful in these compositions may be derivatives of high molecular weight mono- or di- carboxylic acids or anhydrides and various basic, non basic, or heterocyclic amines, or alcohols, or amino alcohols; the Mannich condensation products of high molecular weight alkylated phenols and various amines are also useful. Mixtures of either type of dispersant may be used. Examples include, out are not limited to, the reaction products of a polyisobutenylsuccinic anhydride with polyamine, such as tetraethylene pentamine (TEPA), or the Mannich reaction product of polyisobutylphenol, formalin, and TEPA.

In addition, sulfonates will be required from time to time. These sulfonates may be overbased or neutral salts of Group IA or IIA metals. Natural (i.e., petroleum) or synthetic (i.e., alkylated aryl sulfonic acid type sulfonates of any molecular weight may be used with the proviso that their overbased or neutral salts be oil-soluble or oil-dispersible. Examples of such sulfonates include but are not limited to overbased magnesium and calcium sulfonates.

Wear inhibitors suitable for use in the present invention may be chosen from Group IIA or IIB dithiophosphates. In the present invention, zinc dialkyl dithiophosphates are preferred. The viscosity index improver may be a dispersant or non-dispersant type and may be derived from olefin polymers or other materials. Any of the several types of viscosity index improvers known in the art may be used in this invention. Particularly preferred are hydrogenated styrene-diene copolymers or nitrogen containing derivatives of oxidized ethylene-propylene copolymers.

An antioxidant may also be required in the present invention. Without an antioxidant, the lubricant could be rendered ineffective because it would be oxidatively degraded.

Excessive oil thickening, the result of oxidation of the lubricating oil and/or the other additives that make up the present lubricating composition, can also have a deleterious effect on the fuel conserving properties of this composition. The preferred oxidation inhibitor for this invention is an aromatic amine with the generalized structure shown below:

$$R'\text{-}C_6H_4\text{-}NH\text{-}C_6H_4\text{-}R$$

wherein R and R' can be the same or different and are $C_3$ to $C_{50}$ alkyl, cycloalkyl, or aromatic groups.

Also useful are sulfides with the generalized structures shown below:

R-S-R' and/or R-S-S-R' wherein R and R' have the same meaning as above, formed by the reaction of alpha-olefins with elemental sulfur.

The foregoing specification and the examples are intended as illustrative but are not to oe taken as limiting. Still other variations within the spirit and scope of this invention are possible and will present themselves to one skilled in the art.

We claim:

1. A method for preparing a lubricating composition treated with a friction modifier comprising partial esters of glycerol and oleic acid, the method comprising: (a) modifying a mixture of partial esters of glycerol and oleic acid that comprises glycerol monooleate, glycerol dioleate and unreacted glycerol, by removing said unreacted glycerol therefrom until the amount of unreacted glycerol in the mixture is reduced to a level of about 1 wt.% or less based on the total weight of glycerol esters and glycerol present in the mixture; and (b) incorporating the modified partial ester mixture in a lubricating oil in an amount within the range of about 0.3 to about 1 wt.% of the oil.

* * * * *